US005759976A

United States Patent [19]

Roach et al.

[11] Patent Number: 5,759,976

[45] Date of Patent: Jun. 2, 1998

[54] PROCESS FOR FORMING TABLETED HIGH-CAUSTIC DETERGENT

[75] Inventors: Kenneth James Roach, Canton; Patricia Anderson, Northville, both of Mich.

[73] Assignee: Diversey Lever, Inc., Plymouth, Mich.

[21] Appl. No.: 898,013

[22] Filed: Jul. 22, 1997

Related U.S. Application Data

[63] Continuation of Ser. No. 408,538, Mar. 22, 1995, abandoned, which is a continuation-in-part of Ser. No. 120,563, Sep. 13, 1993, abandoned.

[51] Int. Cl.[6] ..... C11D 17/00; C11D 7/36; C11D 7/14; C11D 7/16

[52] U.S. Cl. ..... 510/218; 510/220; 510/224; 510/225; 510/446; 510/510; 510/511; 510/534

[58] Field of Search ..... 510/218, 224, 510/220, 225, 446, 510, 511, 534

[56] References Cited

U.S. PATENT DOCUMENTS

| | | | |
|---|---|---|---|
| 4,219,436 | 8/1980 | Gomer et al. | 252/135 |
| 4,897,212 | 1/1990 | Kruse et al. | 252/99 |
| 4,931,202 | 6/1990 | Cotter et al. | 252/99 |
| 5,133,852 | 7/1992 | Chun et al. | 252/90 |

FOREIGN PATENT DOCUMENTS

| | | |
|---|---|---|
| 375022A3 | 6/1990 | European Pat. Off. . |
| 05225766 | 9/1992 | European Pat. Off. . |
| 3326459 | 7/1983 | Germany . |
| 3326459 | 1/1985 | Germany . |
| WO 9220775 | 11/1992 | WIPO . |
| WO 9300419 | 1/1993 | WIPO . |

*Primary Examiner*—Christine Skane
*Assistant Examiner*—Necholus Ogden
*Attorney, Agent, or Firm*—A. Kate Huffman

[57] ABSTRACT

Tableted detergents are formed from a hydrated phosphate sequestrant, caustic, free water and, optionally, fillers by combining the products and tableting the components without permitting the tablets or detergent to exceed 50° C. In a preferred embodiment where fillers are incorporated, all free water is combined with the phosphate sequestrants, both anhydrous and hydrated. After the water has been absorbed by the sequestrants, the filler and caustic can be added and the detergent tableted. The free water is bound sufficiently tightly to the phosphate sequestrant that it does not rapidly react with the anhydrous caustic, maintaining the temperature at less than 50° C., which in turn prevents the water of hydration in the phosphates from reacting and thereby weakening the formed tablets. The tablets can also be formed by combining the filler with the phosphate sequestrants and water and subsequently adding caustic if the detergent is cooled and its temperature maintained below 50° C. until the hydration reaction with the caustic and free water is complete.

12 Claims, No Drawings

PROCESS FOR FORMING TABLETED HIGH-CAUSTIC DETERGENT

RELATED APPLICATIONS

This application is a file wrapper continuation of application Ser. No. 08/408,538 filed on Mar. 22, 1995 now abandoned, which is a continuation-in-part of application Ser. No. 08/120,563 filed Sep. 13, 1993, abandoned, entitled "Tableted Detergent, Method of Manufacture and Use."

BACKGROUND OF THE INVENTION

The institutional detergent market distributes a variety of products for washing silverware, pots and pans, dishes, floors, walls, stainless steel surfaces, tile and other areas.

Unlike products used in the home, institutional detergents are often sold in bulk and dispensed from mechanical dispensers. There are a variety of different physical forms these can take, including liquids, powders, solidified bricks, granules and tablets. Several factors enter into the determination of which particular physical form is most suitable for the desired application.

Feed rate is a very important consideration. With a liquid, where the product is directly injected for use, use concentration is easy to control. Unfortunately with liquids, the concentration of active components in the product is generally relatively low and therefore the container size can be prohibitively large. With solid forms, which are dissolved with water, the rate of dissolution will influence dispensing rate.

Delivering consistent feedstock is very important. With a brick formulation, the product consistency can be maintained to a certain extent, but dissolution rate can be slow and, as with many forms, there may also be problems with disposing of the container.

Another very important factor in distributing institutional detergents is packaging. For environmental reasons, it is preferable to minimize packaging. U.S. Pat. No. 5,078,306 discloses a bag of detergent tablets wherein the bag is a water soluble material. This product is apparently designed to minimize packaging, but has several significant disadvantages. Primarily, with a water soluble bag, the water will act to dissolve the plastic bag. However, the undissolved residue of such bags tend to clog the dispenser. Also with a water soluble bag, there is the requirement of an exterior overwrap to prevent humidity or extraneous water from destroying the water soluble bag during shipping and storage.

All of these problems are compounded with highly hygroscopic (highly caustic) and/or hydratable materials. Of course, with the caustic materials, the operators should never physically handle the detergent. Powdered cleaning compounds are typically dispensed with water. Given that premature exposure to water tends to increase the caking tendency of powders, clogging of the dispenser and uniform dispensing from powder systems, especially those prone to prolonged periods of inactivity, may be a problem.

Many detergents, particularly highly caustic detergents, dissolve in water and liberate a great deal of heat. It is therefore preferable to control the dissolution rate of these detergents to avoid temperature peaks in the dispensing equipment.

With tableted, high-caustic detergent, a further problem can be encountered. Anhydrous sodium hydroxide and potassium hydroxide are, of course, very hygroscopic. Typical detergent formulations generally include some free water, and certainly water of hydration from sources such as sodium tripolyphosphate hexahydrate. When tableting, the caustic comes into very close physical proximity to the water. The water is necessary for the tableting to occur at reasonable pressures. But once combined together, the caustic will exothermically react with the free water. For tableted high caustic detergents, if this reaction occurs after compression, the mechanical strength of the tablet will be reduced.

SUMMARY OF THE INVENTION

Accordingly, it is an object of the present invention to provide a method of forming a tableted detergent which includes phosphate sequestrants, free water, and high levels of caustic. Further, it is an object of the present invention to provide such a product wherein the formed tablets do not deteriorate quickly after formation.

These objects and advantages of the present invention can be achieved by combining the individual components of the detergent, including the phosphate along with free water and caustic, in such a manner and/or order of addition that the overall temperature of the product at no time exceeds 75° C. and preferably never exceeds 50° C. and most preferably never exceeds 40° C. Careful blending, selection of raw materials and proper order of addition which factors in the hygroscopic nature of the materials and the lability of water, once absorbed, combine to achieve this result.

In one preferred embodiment of the present invention wherein fillers are included in the detergent formulation, the phosphate sequestrants, i.e., sodium tripolyphosphate, anhydrous and hexahydrate, are combined together with any liquid components including all free water. After the liquid components are absorbed into the sequestrants, caustic, filler and any bleaching agent are added. The product can then be compressed to form tablets. In this manner, the hydration reaction is adequately controlled, i.e., the free water is absorbed by the species most capable of retaining it in the presence of caustic, thus reducing the potential for an exothermic reaction and subsequent deterioration of the tablet.

In an alternate embodiment of the present invention, cooling can be employed to physically control the temperature of the mixture, thereby preventing an undesirable excessively exothermic reaction. This, however, requires significant cooling time.

The objects and advantages of the present invention will be further appreciated in light of the following detailed description.

DETAILED DESCRIPTION

The present invention is a method of making a high caustic tableted detergent, particularly a ware washing detergent. This ware washing detergent will include a source of caustic, a hardness sequestering system including a hydrated phosphate, low molecular weight water-soluble polymers, non-ionic defoaming surfactants, processing aids and optionally bleaching sources.

The caustic source can be sodium or potassium hydroxide with sodium hydroxide preferred. Generally, for use in the present invention, this will include from about 20 to about 70% caustic with about 45% to about 57% caustic being preferred. The caustic will be less than fully hydrated and is preferably substantially anhydrous.

The hardness sequestering system can be a variety of different chemical components. The primary sequestrants are alkali metal salts of polyphosphates. Optional sequestrants include alkali metal salts of phosphonic acid and of gluconic acid, alkali metal salts of ethylene diamine tetraacetic acid (EDTA), alkali metal salts of nitrilotriacetic acid (NTA) and alkali metal salts of polycarboxylic acids such as polyacrylic acid, polymaleic acid and mixtures thereof.

Phosphates are commonly available in anhydrous or hexahydrate forms. For purposes of the present invention, a mixture of anhydrous and hydrated phosphates is preferred. The composition should include at least 10% hydrated phosphate sequestrant, based on total formulation.

Generally, the hardness sequestering system of the present invention will form 20 to about 80% of the overall mass of the detergent composition, and preferably about 35 to 40%. A mixture of hydrated (hexahydrate) and anhydrous sodium tripolyphosphate in the mass ratio of 3:1 to about 1:3, and preferably 1:1 to 2:1. In areas where the amount of phosphates is regulated, it may be necessary to supplement the water hardness control ability of the product by adding other sequestrants such as the alkali metal salts of NTA or EDTA.

The present invention can optionally include a chlorine source. One preferred chlorine source is dichloroisocyanurate. This is added in amounts of up to 7% by weight. Other bleaching aids including alkali metal perborates and percarbonates may also be used.

In addition to the above, the detergent composition may include defoaming surfactants. One typical class of anionic defoaming surfactants is the phosphate esters. The defoaming nonionic surfactant used herein is selected from the group consisting of alcohol alkoxylates, alkyl alkoxylates, block copolymers and mixtures thereof. Generally, these nonionic surfactants are prepared by the condensation reaction of a suitable amount of ethylene oxide and/or propylene oxide with a selected organic hydrophobic base under suitable oxyalkylation conditions. These reactions are well known and documented in the prior art. Generally, these will have a molecular weight of 900 to about 4,000. One such surfactant is an ethylene oxide propylene oxide block copolymer. Commercially available surfactants include Triton CF32, Triton DF12, Plurafac LF131, Plurafac LF132, Plurafac LF231, Industrol N3 and Genapol PN30. These can be included in an amount from about 0.5 to about 5% with about 1.5% preferred.

In addition to this, low molecular weight (2,000–20,000), water-soluble polybasic acids such as polyacrylic acid, polymaleic or polymethacrylic acid or copolymeric acids can be used as sequestering aids, to inhibit growth of calcium carbonate crystals and to improve rinseability. Preferably the water-soluble polymer will be a polycarboxylic acid such as polyacrylic acid having a molecular weight of around 5000. Generally, the present invention should include from about 1% to about 4% polyacrylic acid on an actives basis with about 2% preferred.

The detergent formulation may also include 1% to 5% of a polyhydric water soluble alcohol. Suitable water soluble polyhydric alcohols include propylene glycol, ethylene glycol, polyethylene glycol, glycerine, pentaerythritol, trimethylol propane, triethanolamine, tri-isopropanol amine and the like. Propylene glycol is preferred. This acts as both a processing aid and a dissolution aid for the tablet, as is discussed below.

In order to provide a strong tablet the present invention will include from about 2 to 10% liquid components, preferably less than 8%. Generally, this can be provided for by the nonionic surfactant, the polyalcohols and/or free water. The formulation should also include 2% to 10% by weight of water of hydration. This also provides for a stronger tablet. Generally, there will be at least 0.5% up to 5% free water in the composition. This can be the solvent for the polymer or surfactant. It is preferable to keep the free water less than 5% and the total liquid at less than 10% to keep the product flowable and non-tacky during the tableting.

In addition to the above, the detergent formulation can include optional ingredients commonly referred to as fillers such as soda ash, the silicates such as sodium and potassium silicate and polysilicate, and sodium metasilicate and hydrates thereof, alkali metal chloride, alkali metal sulfates and alkali metal bicarbonate. These can be present in an amount of 1% to 30% by weight.

A preferred formulation for use in the present invention includes the following:

TABLE 1

| | |
|---|---|
| | Solid Components: |
| 10.0% | soda ash |
| 21.0% | sodium tripolyphosphate hexahydrate (18% water of hydration) |
| 16.3% | sodium tripolyphosphate powder |
| 0.2% | sodium dichloro-isocyanurate (ACL-60) |
| 45.0% | caustic bead |
| | Liquid Components: |
| 4.5% | 5000 molecular weight polyacrylic acid (48% active in water) |
| 1.5% | ethylene oxide propylene oxide block copolymer non-ionic surfactant |
| 1.5% | propylene glycol |

In this formulation, the sodium tripolyphosphate hexahydrate provides 3.8% water of hydration and the polyacrylic acid provides about 2.3% free water.

A very high caustic formula includes:

TABLE 2

| | |
|---|---|
| | Solid Components: |
| 21.0% | sodium tripolyphosphate hexahydrate (18% water of hydration) |
| 16.3% | sodium tripolyphosphate powder |
| 56.7% | caustic bead |
| | Liquid Components: |
| 3.0% | 5000 molecular weight polyacrylic acid (48% active in water) |
| 1.5% | ethylene oxide propylene oxide block copolymer non-ionic surfactant |
| 1.5% | propylene glycol |

A third formulation which includes trisodium NTA is shown at Table 3.

TABLE 3

| | |
|---|---|
| 21.0% | sodium tripolyphosphate hexahydrate (18% water of hydration) |
| 16.3% | anhydrous sodium tripolyphosphate |
| 10.0% | Trisodium NTA |
| 1.7% | soda ash |
| 45.0% | caustic |
| 3.0% | 5000 mw acrylic acid (48% active) |

TABLE 3-continued

| | |
|---|---|
| 1.5% | EOPO block copolymer |
| 1.5% | propylene glycol |

In order to formulate the detergent of the present invention, the phosphates are combined together and mixed in a ribbon or paddle blender. The fillers and other non-hygroscopic materials are not added at this time. Since a very low concentration of the liquid components is being added to the formulation, the liquid components should be combined prior to blending with the sequestrants. Normally, the ethylene oxide propylene oxide block copolymer will react with the polyacrylic acid to form a solid or gel. However, mixing the propylene glycol with these two liquid components prevents this reaction.

Thus, any liquid components such as polyacrylic acid dissolved in water, the nonionic surfactant and the propylene glycol, are thoroughly mixed together and then sprayed evenly on the phosphate with mixing and allowed to soak into the phosphate. The caustic is added, then the fillers and finally the dichloroisocyanurate. If NTA or EDTA are added, these should generally be added with the fillers, i.e., after the caustic.

It is very important that during all stages of mixing, and even after formulation, the temperature be kept at less than 75° C., preferably less than about 50° C. and preferably less than 40° C. It is theorized that hydration of the caustic generates heat which, if excessive, will cause the STPP hexahydrate to liberate water, most likely accompanied by the decomposition of the tripolyphosphate anion, which will generate more heat, weakening the tablet. However, by allowing the free water to be effectively completely absorbed by the phosphate, the hydration reaction is sufficiently slowed and excessive heat is not generated and the hexahydrate does not give up water.

If the free water is added to the fillers, or even to a mixture of filler and sequestrant, then that water which hydrates the filler is relatively easily accessed by the caustic and the resulting hydration is so rapid, generating so much heat, that the hydrated phosphate gives up water causing the formed tablets to crumble or weaken.

The detergent blend is then pressed to form tablets using a standard tableting machine. One such machine suitable for use in the present invention is the Stokes brand tableter. Generally, to form tablets, the powder is subjected to 4 to 10 tons pressure. Generally, the tablet will have a thickness of about 12 to 13 mm and a diameter of about 20 mm. The maximum diameter will be a function of the dispenser/feed water interface area.

The tablets of the end product after being produced do not weaken significantly over time. These can then be used in a typical ware washer apparatus equipped with a water spray detergent dispenser.

There are alternate methods to achieve this same result. An initial method of achieving this result is to omit fillers and form the detergent with anhydrous and hydrated sequestrants, along with the previously mentioned liquid components, as shown in Table 2. The phosphates are combined with the liquid component so that any free water present is adsorbed onto the sequestrants. The caustic is then added and the mixture tableted. Again, because the phosphates hold the water relatively tightly, the temperature at all times is maintained at less than 75° C. and generally less than 50° C. and therefore the hexahydrate will not liberate water which can react with the caustic. The formed tablets do not deteriorate rapidly after formation.

In a second alternate method of practicing the invention, the fillers can be combined with the phosphates and the water subsequently added. This can then be blended together with the caustic, provided sufficient cooling is provided so that the temperature is kept less than 50° C. and preferably less than 40° C. This temperature is maintained for sufficient time to allow the caustic to react completely with any labile water prior to the tableting operation. Of course, this requires added processing time.

By employing the preferred method, the formed tablets have a drastically improved storage stability and shelf life. The end products are stronger, which means they are less likely during shipping to break apart and during use they will dissolve more slowly and evenly, providing for an even distribution of the detergent dissolved in water without creating an extreme exotherm. In all, this system provides many unique advantages and although several embodiments of the present invention have been disclosed.

The invention itself should be defined only by the appended claims wherein we claim:

1. A method of forming a tableted detergent from 20% to 60% of a partially hydrated phosphate mixture, anhydrous caustic, 0.5% to 5% free water and 5 to 40% filler comprising:

adding said free water to said phosphate mixture without adding said filler, and allowing said water to be absorbed by said phosphate mixture;

and subsequently adding 20% to 70% caustic to said phosphate mixture to form a second mixture whereby the temperature of said second mixture is maintained at less than 75° C.;

compressing said second mixture to form tablets.

2. The method claimed in claim 1 wherein at least 5% filler is added to said phosphate mixture after said caustic is added to said phosphate mixture.

3. The method claimed in claim 1 wherein said temperature of said second mixture is maintained at less than 50° C.

4. The method claimed in claim 2 wherein said hydrated phosphate comprises a mixture of sodium tripolyphosphate and sodium tripolyphosphate hexahydrate.

5. The method claimed in claim 3 comprising adding fillers to said phosphate mixture after said water has been absorbed by said phosphate.

6. The method claimed in claim 3 comprising 1% to 3% free water.

7. The method claimed in claim 2 wherein said filler is selected from the group consisting of soda ash, alkali metal silicates, alkali metal polysilicates, alkali metal metasilicates, alkali metal chloride, alkali metal sulfates, and alkali metal bicarbonates.

8. The method claimed in claim 2 comprising 40 to 70% caustic.

9. The method claimed in claim 3 wherein the temperature of said second mixture is maintained at less than 40° C.

10. A method of forming a compressed detergent tablet, said tablet comprising:

from about 20% to about 70% by weight caustic;

from about 20% to about 60% by weight of a sequestering agent consisting of a combination of sodium tripolyphosphate and sodium tripolyphosphate hexahydrate;

from about 1 to about 4% by weight polycarboxylic acid having a molecular weight of 2,000 to 20,000;

from about 0.5 to 5% by weight of a defoaming agent, and from about 1 to about 5% by weight propylene glycol and from about 5% to about 40% filler;

and free water;

said method comprising combining said propylene glycol, said defoaming agent, said polycarboxylic acid and said free water to form a liquid mixture, combining said liquid mixture with said sequestering agents, and permitting said liquid mixture to be adsorbed by said sequestering agents to form a first detergent mixture;

subsequently combining said filler and said caustic to said first detergent mixture to form a second detergent mixture and compacting said second detergent mixture to form tablets whereby the order of addition of the detergent components prevents the second detergent mixture from reaching a temperature in excess of 50° C.

11. The method claimed in claim 10 wherein said fillers are selected from the group consisting of alkali metal silicates, alkali metal polysilicates, alkali metal metasilicates, alkali metal chlorides, alkali metal sulfates, alkali metal carbonates, and alkali metal bicarbonates.

12. A method of forming a tableted detergent form 20% to 60% from a partially hydrated phosphate mixture, anhydrous caustic, 0.5% to 5% free water and 5% to 40% filler comprising:

Combining said free water with said phosphate mixture, said filler and 20% to 70% caustic to form a detergent mixture; cooling said detergent mixture to prevent said detergent mixture from heating to above 50° C. for a period of time effective to prevent said caustic from reacting further with said free water;

Compressing said mixture to form a tablet.

* * * * *